US006768468B2

(12) United States Patent
Crouch et al.

(10) Patent No.: US 6,768,468 B2
(45) Date of Patent: Jul. 27, 2004

(54) REFLECTING SURFACES HAVING GEOMETRIES INDEPENDENT OF GEOMETRIES OF WAVEFRONTS REFLECTED THEREFROM

(75) Inventors: David D. Crouch, Corona, CA (US); William E. Dolash, Montclair, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 09/965,206

(22) Filed: Sep. 27, 2001

(65) Prior Publication Data

US 2003/0058189 A1 Mar. 27, 2003

(51) Int. Cl.[7] ..... H01Q 19/08; H01Q 15/10
(52) U.S. Cl. ..... 343/753; 343/909
(58) Field of Search ..... 343/753–755, 343/840, 909, 911 R

(56) References Cited

U.S. PATENT DOCUMENTS 2,528,582 A * 11/1950 De Vore ..... 343/909
2,617,030 A * 11/1952 Rust et al. ..... 343/755
3,706,998 A 12/1972 Hatcher et al. ..... 343/754
4,905,014 A 2/1990 Gonzalez et al. ..... 343/909
6,370,398 B1 * 4/2002 Kanamaluru et al. ..... 343/755
6,429,823 B1 * 8/2002 Bains et al. ..... 343/755

OTHER PUBLICATIONS

Chen, Chao–Chun, *Transmission of Microwave Through Perforated Flat Plates of Finite Thickness*, IEEE Transactions on Microwave Theory and Techniques, vol. MTT–21, No. 1, Jan. 1973.

* cited by examiner

*Primary Examiner*—Michael C. Wilmer
(74) *Attorney, Agent, or Firm*—Renner, Otto, Boisselle & Sklar; Thomas J. Finn; Philip P. Berestecki

(57) ABSTRACT

A flat metal plate (20) has a plurality of holes (50) that have a property that changes across the surface of the plate so that the flat plate (20) mimics the behavior of a curved wavefront transformer. The changing property can include a dimension, such as radius or depth, such that the holes (50) near the center of the plate (20) are smaller, for example, than the holes (50) further away from the center of the plate (20). The size of each hole (50) is a function of the local phase change imparted on an electromagnetic wave of a particular wavelength or frequency that hits the hole (50), plus the propagation phase change that occurs in the reflected wave exiting the hole (50) as it travels the distance between the hole (50) and the focal point.

35 Claims, 4 Drawing Sheets

REFLECTING SURFACES HAVING GEOMETRIES INDEPENDENT OF GEOMETRIES OF WAVEFRONTS REFLECTED THEREFROM

FIELD OF THE INVENTION

The present invention is related to a reflecting surface for synthesis of reflected wavefronts therefrom for use in reflecting antennas and mirrors, for example. More particularly, the present invention is related to a system and method of making and using such a reflecting surface that is particularly useful for reflecting millimeter-wave frequencies.

BACKGROUND OF THE INVENTION

Reflecting antennas and mirrors, such as those used in beam-waveguide systems, tend to be difficult and expensive to build for millimeter-wave frequencies because the mechanical tolerances required to achieve the best signal are difficult to attain. For example, as a general rule the reflecting surface of a parabolic reflector must conform to the ideal paraboloid to within approximately one-fiftieth of a wavelength. At a frequency of 100 GHz, this corresponds to a tolerance of approximately 2 mils (about 50.8 $\mu$m). As the frequency and/or the size of the reflector increases, holding the required tolerance becomes more difficult. A regular curved surface, such as a paraboloid or hyperboloid, is particularly difficult to manufacture to a high degree of precision.

As difficult as it can be to manufacture a regular curved surface, some applications require an irregular curved surface in order to produce a desired far-field pattern, or an irregular reflecting surface (in a beam-waveguide system, for example) to correct the phase of the incident beam. Depending on the frequency and the required degree of irregularity, such a curved surface may be cost prohibitive to machine and in some cases impossible to manufacture with current manufacturing techniques.

Flat Parabolic Surface (FLAPS) antenna technology attempts to solve this problem by using an array of dipoles separated from a ground plane by a dielectric layer. The local phase shift imparted to the wave reflected from the FLAPS surface is determined by the geometry of nearby dipoles. By proper variation of the dipole geometry and spacing as a function of location on the FLAPS surface, the properties of a conventional curved reflecting antenna can be emulated.

Unfortunately, however, dielectrics generally are not environmentally rugged, and must be protected from the weather. In addition, in some applications (experimental inertial-confinement fusion reactors, for example) the beam may carry more than a megawatt of power at frequencies exceeding 100 GHz. Dielectrics tend to be lossy at millimeter-wave frequencies, and are poor conductors of heat, both of which are serious disadvantages in high-power applications. Therefore, use of a dielectric layer to support the dipoles in a FLAPS system generally precludes its use in high power applications.

SUMMARY OF THE INVENTION

Unlike prior systems, the present invention provides a reflecting surface in the form of a plate having cavities of varying dimensions and/or spacing to achieve a desired local phase shift across the reflecting surface, thereby eliminating the need to use dielectric materials. The surface of the plate can be flat or curved. A plane wave incident on the plate undergoes a shift in phase upon reflection, with the local phase shift depending on the dimensions and spacing of the cavities. By properly choosing the cavity dimensions as a function of position on the plate, the wavefronts reflected from the plate can be made to mimic a wavefront reflected from an equivalent curved reflector. In other words, the present invention provides a reflecting structure having a desired surface geometry that can emulate the electromagnetic behavior of an arbitrarily curved surface. For example, a reflecting structure that emulates a parabolic reflector can be embedded in a cylindrical surface, e.g., the skin of an aircraft. Reflecting antennas and mirrors based on this technology offer significant advantages in cost and performance over their conventional-shape counterparts.

More particularly, the present invention provides a wavefront transformer suitable for transforming an incident electromagnetic wavefront having a given shape to a reflected wavefront having a different shape. The wavefront transformer includes a substrate having a conductive surface for reflecting the incident electromagnetic energy, and a plurality of openings in the conductive surface. Each opening is formed by a respective one of a plurality of discrete cavities extending from the conductive surface, and has a selected position on the conductive surface with respect to the focal point to induce a propagation phase shift over the distance to the focal point. Each cavity also includes a local phase shift in the reflected electromagnetic energy as a function of a selected dimension of the cavity. The combined propagation phase shift and local phase shift from the plurality of cavities places the reflected electromagnetic energy in phase at the focal point.

Other features encompassed by the present invention include a wavefront transformer wherein the substrate is a metal plate; wherein the plate is substantially flat; wherein the plate includes a first plate overlying a second plate, wherein the first plate has a plurality of through-holes therein that form the cavities and the second plate forms a flat bottom surface of the cavities; wherein the plate has a substantially uniform thickness; wherein one or more properties of the cavities varies with position with respect to the focal point; wherein the properties that vary include dimensions of the cavities and spacing between neighboring cavities; wherein the dimensions of the cavities include cross-sectional dimensions that include one or more of width, depth and radius; wherein the plurality of cavities form a periodic array; wherein only the positions of the cavities and the selected dimension of the cavities varies, and the dimension of each cavity is selected such that the total phase shift at the focal point of an electromagnetic wave reflected from each cavity is equal, so that $$\phi(r) = \phi(0) + \frac{2\pi}{\lambda}\left(\sqrt{r^2 + f^2} - f\right),$$

where r is the distance of the cavity from a reference point in the plane of the conductive surface, $\phi(r)$ is the local phase shift imposed on an incident electromagnetic wave at r by the flat reflecting surface, f is the focal length of the reflector, $\lambda$ is a desired wavelength of the reflected electromagnetic energy, and $\phi(\mathbf{0})$ is the local phase shift imposed on an incident electromagnetic wave by a cavity at the reference point having a dimension a(0,0).

Other features include a wavefront transformer having a focal length of about four and a half inches (about 11.4 cm); wherein a dimension of the central cavity, a(0,0), is a radius of a circular opening formed by a cylindrical cavity; wherein a(0,0) is about 44.5 mils (about 254 $\mu$m); wherein the cavity dimension is selected for frequencies greater than about 20 GHZ; wherein the cavity dimension is selected for a frequency of about 95 GHz; wherein the cavities have a uniform depth of about 100 mils (about 2.54 mm); wherein the nearest-neighbor distance between adjacent cavities is uniform; wherein the nearest-neighbor distance between adjacent cavities is about 105 mils (about 2.67 mm); wherein the cavities have a depth that is less than a local thickness of the plate; wherein the openings are circular; wherein the cavities are cylindrical; and wherein the plurality of cavities are arrayed in an equilateral-triangular arrangement.

The present invention also provides a reflector suitable for focusing incident electromagnetic energy at an operating wavelength on a focal point, including the wavefront transformer, and an antenna including the reflector and a waveguide feed located at the focal point.

The present invention also provides a method of making a reflector suitable for focusing incident electromagnetic energy at an operating wavelength on a focal point, the wavefront transformer having a substrate with a conductive surface for reflecting the incident electromagnetic energy, and a plurality of openings in the conductive surface, each opening formed by a respective one of a plurality of discrete cavities extending from the conductive surface. The method includes the following steps: selecting a dimension of each cavity as a function of a propagation phase shift and a local phase shift created by the cavity at a desired distance from the focal point, and forming the cavities in a conductive surface, wherein the dimension of each cavity is selected such that the local phase shift imposed on an incident electromagnetic wave is $$\phi(r) = \phi(0) + \frac{2\pi}{\lambda}\left(\sqrt{r^2 + f^2} - f\right)$$

where r is the distance of the cavity from a reference point on the conductive surface, f is the focal length of the wavefront transformer, $\lambda$ is a desired wavelength of the reflected electromagnetic energy, and $\phi$(0) is the local total phase shift imposed on an incident electromagnetic wave at the reference point by a cavity having a dimension a(0,0).

Other features encompassed by the present invention include a method wherein forming the cavities includes forming the cavities in an equilateral-triangular arrangement; forming through-holes in a first plate and mounting the first plate on a backing plate that forms a solid bottom surface for each hole; machine reaming; and using electronic discharge machining.

The present invention also provides an antenna suitable for focusing incident electromagnetic energy at an operating wavelength on a focal point, including a geometrically flat wavefront transformer plate having a conductive surface and a waveguide feed positioned at the focal point suitable to receive the reflected electromagnetic energy. The wavefront transformer plate further includes a plurality of discrete cavities opening in the conductive surface, the dimensions of each cavity varying as a function of the position of the cavity on the plate with respect to the focal point to induce a local phase shift on the incident wave of electromagnetic energy as the electromagnetic energy is reflected, and the cavities being spaced with respect to adjacent cavities to enable the wavefront transformer plate to focus the reflected electromagnetic energy at the focal point such that electromagnetic energy reflected from the wavefront transformer plate is in phase at the focal point.

According to one embodiment of the antenna, the cavities are arrayed in an equilateral-triangular arrangement.

The present invention also provides a reflector suitable for focusing incident electromagnetic energy at an operating wavelength on a focal point, including means for focusing an incident plane wave of any polarization at the focal point.

According to one embodiment of the reflector, the means for focusing includes a substrate having a conductive surface for reflecting the incident electromagnetic energy, and a plurality of discrete cavities having openings in the conductive surface, each cavity forming part of at least one equilateral-triangular arrangement of cavities.

In accordance with an exemplary embodiment of the invention, a reflector is formed of a geometrically flat plate, and only the positions of the cavities and the selected dimension of the cavities are varied across the reflector. The dimension of each cavity is selected such that the portion of the incident wave reflected by each cavity arrives at the focal point with the same phase (within a multiple of $2\pi$ radians). Mathematically, this means that the phase shift imposed on the reflected wave by a cavity a distance r from a reference point in the plane of the conductive surface is $$\phi(r) = \phi(0) + \frac{2\pi}{\lambda}\left(\sqrt{r^2 + f^2} - f\right).$$

In this equation, f is the focal length of the reflector, $\lambda$ is a desired wavelength of the reflected electromagnetic energy, and f(0) is the local phase shift imposed on the reflected wave by a cavity at the reference point having a dimension a(0,0).

A reflector produced in accordance with the present invention does not suffer from the same limitations as prior systems and can be used in place of a curved mirror without sacrificing power carrying capacity. Moreover, the reliance of the reflector on cavities to form the reflected wavefront rather than the curvature of the surface offers flexibility in design, as well as cost advantages, particularly in manufacturing, that otherwise would not be available. These advantages are further enhanced by the improved environmental ruggedness of the reflector.

Accordingly, the present invention provides reflecting surfaces for synthesis of reflected wavefronts of desired shapes, and the reflecting surfaces may have geometries that are independent of the geometry of the reflected wavefront. In other words, a flat plate can produce a parabolic reflected wavefront, for example.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

Figure 1:
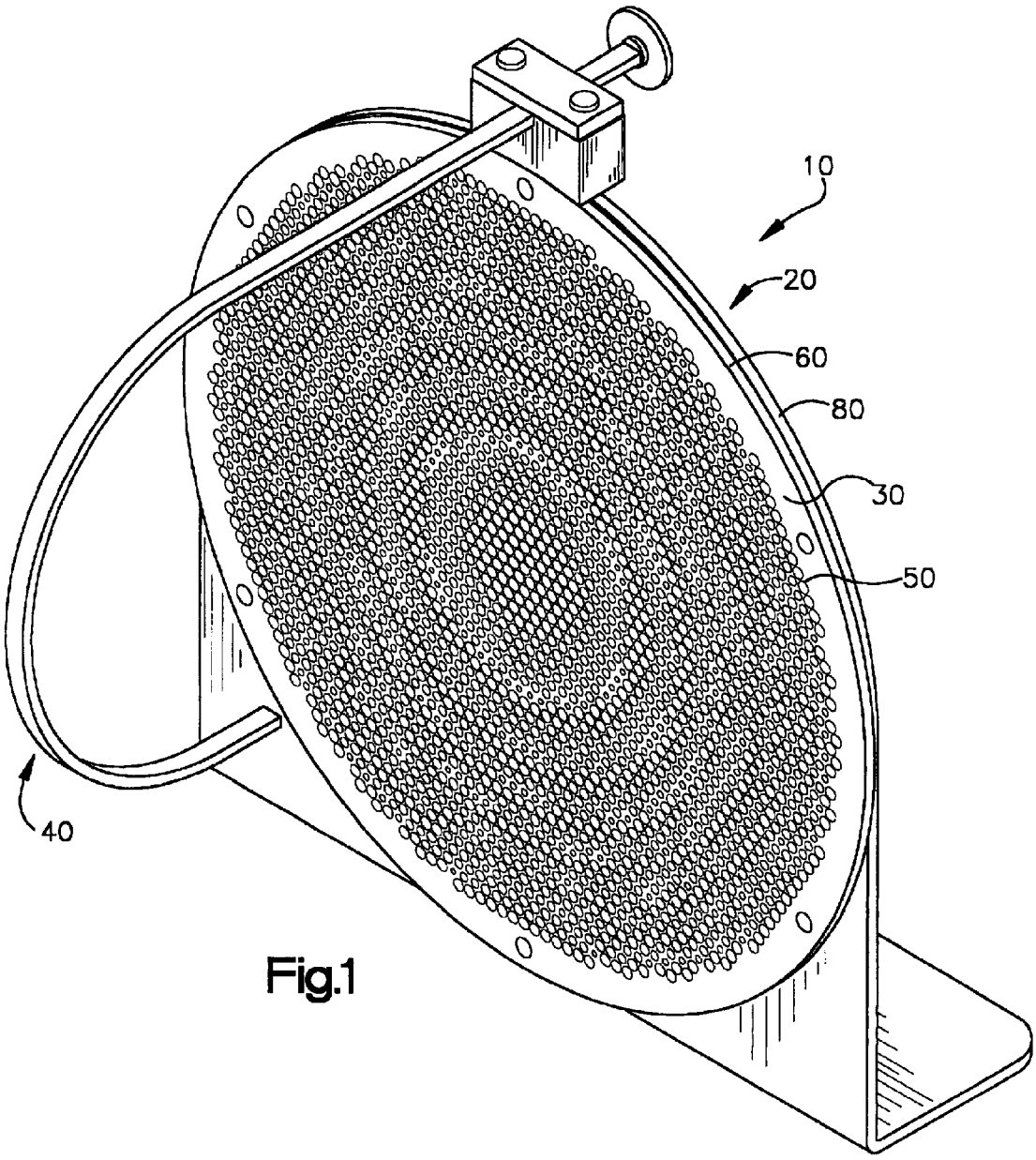
FIG. 1 is a perspective view of an antenna formed in accordance with the present invention.
Figure 2:
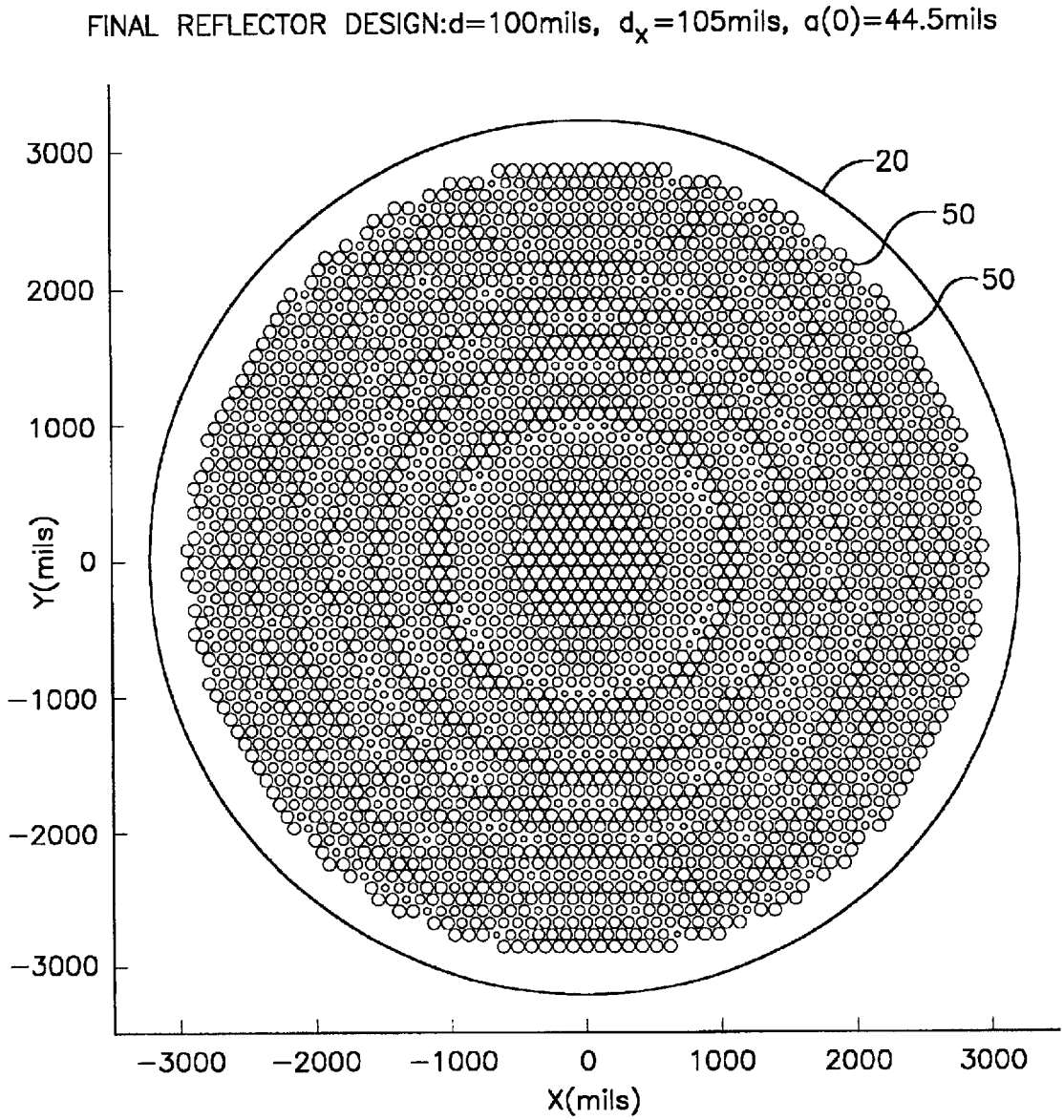
FIG. 2 is a graphical representation of a layout for an exemplary flat reflector in accordance with the present invention.
Figure 3:
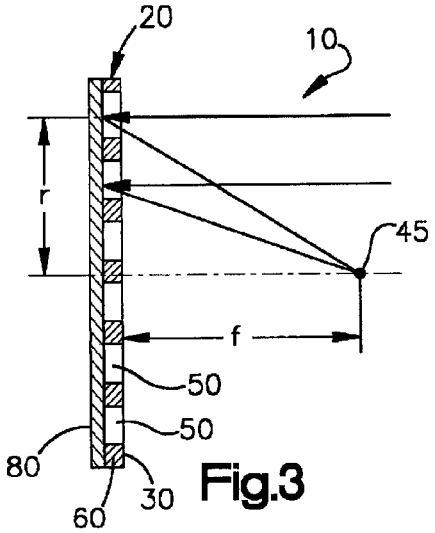
FIG. 3 is a cross-sectional view of the reflector of FIG. 2 with a schematic representation of a plane wave normally incident on the reflector.

Referring initially to FIGS. 1–3, an exemplary antenna 10 formed in accordance with the invention is shown. The antenna includes a reflector plate 20 having a reflecting surface 30 that reflects incident electromagnetic energy, and a waveguide feed 40 positioned at the focal point 45 of the reflector plate to emit or receive an electromagnetic signal. In a receive mode, electromagnetic energy incident on the surface of the reflector plate is reflected toward the focal point where it is collected by the waveguide feed. In a transmit mode, electromagnetic energy from the waveguide feed illuminates the surface of the reflector plate and is reflected outward with respect to the bore axis of the reflector plate.

In the exemplary embodiment shown and described herein, the reflector plate 20 is a metal plate forming a substantially flat conductive reflecting surface 30. The reflector plate may be formed of any structurally suitable material that supports a conductive material on the surface to reflect incident electromagnetic energy. Additionally, the reflector plate may have any shape, including a plate having a constant, variable or irregular thickness. The conductive surface has a plurality of openings 50 that are spaced to form an array extending across the reflector plate. The openings extend through the surface of the plate to form discrete, unconnected slots or cavities that preferably have a flat bottom surface.

In the illustrated embodiment, the reflector plate 20 is formed in two pieces; a flat backing plate 80, forming the flat bottom surfaces of the cavities, is mounted to a perforated surface plate 60 having a plurality of through-holes, forming the opening and side surfaces of the cavities 50. The resulting array of cavities is about 6 inches (about 15.2 cm) in diameter, and the overall diameter of the reflector plate is about 6.625 inches (about 16.83 cm).

In general terms, the present invention provides a wavefront transformer, such as the illustrated reflector 10, that transforms an incident electromagnetic wavefront of a given shape into a reflected wavefront having a different shape, the wavefront generally being a surface of constant phase. A reflector can transform an incident plane wave into a spherical wave.

The cavities in the conductive surface impose a local phase shift on a reflected electromagnetic wave. The phase of the electromagnetic wave reflected from a portion of the reflector as it arrives at the focal point is the sum of the local phase shift determined by the geometry and size of the cavity, and a propagation phase shift determined by the distance from the cavity to the focal point. The antenna provided by the present invention approximates the performance of a curved reflecting antenna through proper variation of the cavity dimensions and/or spacing between adjacent cavities with respect to position on the reflecting surface relative to the desired focal point.

The local phase shift imposed by a particular cavity is dependent on the shape and dimensions (including volume, depth and cross-sectional dimensions or size) of the cavity, and its spacing relative to neighboring cavities. If the shape and spacing are substantially uniform across the reflector, as in the illustrated embodiment, for example, proper variation of one or more of the dimensions of the cavities, such as the depth or the cross-sectional size, provides the desired local phase shift.

Further, a plane wave incident on a parabolic reflector, for example, provides reflected electromagnetic waves that travel equal path lengths from the reflector plate to the focal point. Thus the propagation phase shifts are equal regardless of where the wavefront impinges on the surface of the parabolic reflector plate. However, for a plane wave incident on a flat plate (as shown in FIG. 3), the reflected waves travel unequal path lengths to reach the focal point and thus have differing propagation phase shifts. Rather than equalize the path lengths, the present invention provides a reflector plate 20 with cavities 50 that impart local phase shifts on the reflected waves so that despite the different path lengths of the reflected waves, they arrive at the focal point 45 in phase.

In combination with the phase shift imparted as a result of path length differences from individual cavities to the focal point, the local phase shift is selected to place the reflected waves in phase at the focal point so that they add, creating a strong and clear signal. The reflector can thus emulate a curved reflector.

In the illustrated embodiment, the depth and spacing between adjacent cavities were selected to be substantially uniform, and a single volumetric shape, i.e., a cylindrical shape, was selected such that the volume varies with the size of the circular cavity opening. Varying only one dimension and the position of the cavities simplified the calculations used to determine the properties of a cavity that produce a desired phase shift. In the illustrated embodiment, cylindrical cavities are arranged form an equilateral triangular array of circular openings in the surface of the plate, simplifying the calculations, and providing certain advantages in cost and ease of fabrication. The local phase shift imposed on an electromagnetic wave reflected from such a structure depends primarily on the local cavity size, in this case the radius. An equilateral triangular arrangement also provides phase shifts that are nearly identical for any polarization, or combination of polarizations.

To further illustrate the principles that govern the operation of the antenna, consider that the illustrated exemplary reflector plate is a flat, center-fed reflector plate having a focal point at a focal length of f. The focal length is a distance along a perpendicular axis from the reflecting surface to the focal point and may coincide with the bore axis of the reflector plate. In the illustrated embodiment, the perpendicular axis (in this case the center axis) from the surface to the focal point passes through the center of the reflecting surface. (To facilitate the description, references herein to the center refer to the position of the center axis, although the focal point need not lie on a perpendicular axis passing through the geometric center of the plate.)

The rays shown in FIG. 3 represent a plane wave normally incident on such a flat reflecting surface. When the sum of the local phase shift imposed by a cavity on the reflected wave and the phase shift due to propagation from the reflecting surface to the focal point is independent of r (within a multiple of $2\pi$ radians), where r is a distance to a particular cavity measured along a perpendicular to the center axis, waves reflected from different parts of the reflector plate add in phase at the focal point.

Mathematically, this means that $$\Phi(r) = \phi(r) - \frac{2\pi}{\lambda}\sqrt{r^2 + f^2} \quad (1)$$

where $\phi(r)$ is the local phase shift imposed by the flat reflecting surface at a distance r from the axis, and $\Phi(r)$ is the total phase shift at the focal point due to reflection from the surface and propagation from the surface to the focal point. To mimic a center-fed parabolic reflector, $\Phi(r)$ is advantageously independent of r, which requires that $$\phi(r) = C + \frac{2\pi}{\lambda}\sqrt{r^2 + f^2} \quad (2)$$

where C is an arbitrary constant. The constant C may conveniently be assigned the value $\phi(\mathbf{0})-2\pi f/\lambda$, for example, so that $\phi(r)$ assumes the form $$\phi(r) = \phi(0) + \frac{2\pi}{\lambda}\left(\sqrt{r^2 + f^2} - f\right). \quad (3)$$

Given the wavelength $\lambda$ and the focal length f, the design of the reflector plate is determined by the value of $\phi(\mathbf{0})$. $\phi(\mathbf{0})$ represents the phase shift imposed on an electromagnetic wave reflected from the center of the reflecting surface and is determined by the dimensions of the cavity at the center of the reflector plate, i.e., a(0,0), the radius of the cavity at the center of the reflector plate.

A center-fed reflector having a focal length of f can be synthesized by varying the cavity radius a(x,y) with position r(x,y) in such a way that the total phase shift imposed by the cavity located at position r(x,y) is $\phi(r)$. The design of the plate then is determined by choosing a radius for the cavity at the center of the plate, which determines $\phi(\mathbf{0})$, the total phase shift imposed by the cavity located at position r(0,0). The radii of the remaining cavities are then chosen to satisfy Equation (3) within a multiple of $2\pi$ radians (360°).

However, because of the interaction of the fields scattered by neighboring cavities, the dimensions of a single cavity are not calculated in isolation. Rather, the varying property (such as the size and/or depth) of a particular cavity is approximated by assuming that the cavity is part of an infinite periodic array of identical cavities.

The periodicity of the structure and the plane-wave excitation make it possible to calculate the reflected-wave phase shifts by approximating the reflected wave with a finite number of discrete plane waves (Floquet modes) and the fields in the cavities with a finite number of waveguide modes. By applying boundary conditions to the tangential electric and magnetic fields at the surface of the reflector plate, i.e., by imposing continuity on the tangential electric and magnetic fields, one can determine the coefficients of the waveguide and Floquet modes. These coefficients form the basis for a matrix that can be resolved to determine the unknown waveguide mode amplitudes. The total phase shift of the reflected plane wave at the focal point is then derived from the solution to this matrix equation. For further details on this method, see Chao-Chun Chen, *Transmission of Microwaves Through Perforated Flat Plates of Finite Thickness*, MTT-21 IEEE Trans. on Microwave Theory and Techs. 1 (January 1973). Compare, U.S. Pat. No. 4,905,014 to Gonzalez, et al.

Figure 4:
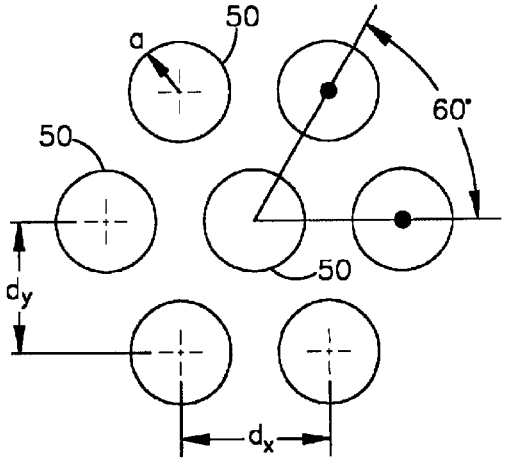
FIG. 4 is an enlarged schematic view of an equilateral-triangular layout of cavities for a reflector formed in accordance with the present invention.
Figure 5:
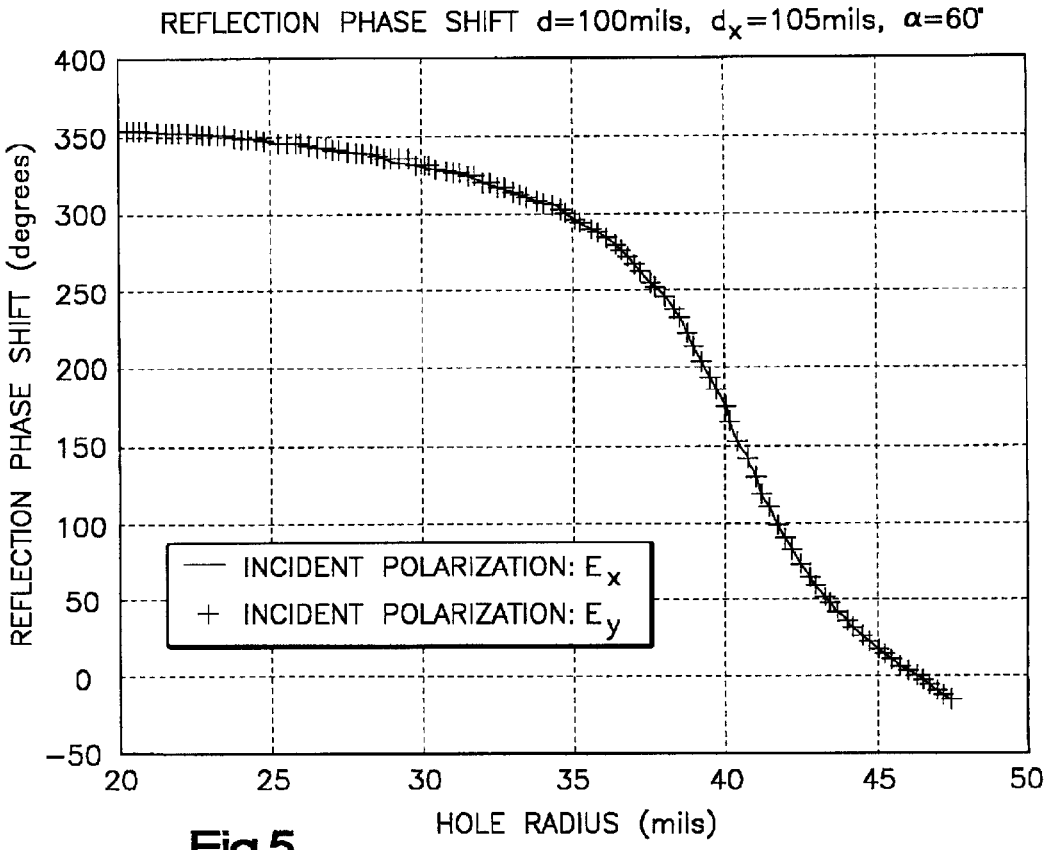
FIG. 5 is a graph showing the reflection phase shift as a function of cavity size for orthogonally-polarized plane waves incident on an equilateral-triangular array as shown in FIG. 4.

In an exemplary embodiment, consider the results of such a calculation for a 95 GHZ plane wave normally incident on an equilateral-triangular array of cavities 50 (see FIG. 4) as shown in FIG. 5. FIG. 5 shows the local phase shift plotted as a function of cavity radius for a plate 20 (FIG. 4) perforated by cavities having a uniform depth of about 100 mils (about 2.54 mm), and a nearest-neighbor distance ($d_x$) (FIG. 4) between adjacent cavities of approximately 105 mils (about 2.67 mm). The local phase shifts are plotted for normally-incident plane waves whose electric fields are polarized along both x and y directions (for x and y as defined in FIGS. 2 and 4). For either incident polarization, the local phase shift imposed on the reflected wave varies over a range exceeding 360° ($2\pi$ radians) as the hole radius increases from about 20 mils (about 0.5 mm) to about 47.5 mils (about 1.2 mm).

Figure 6:
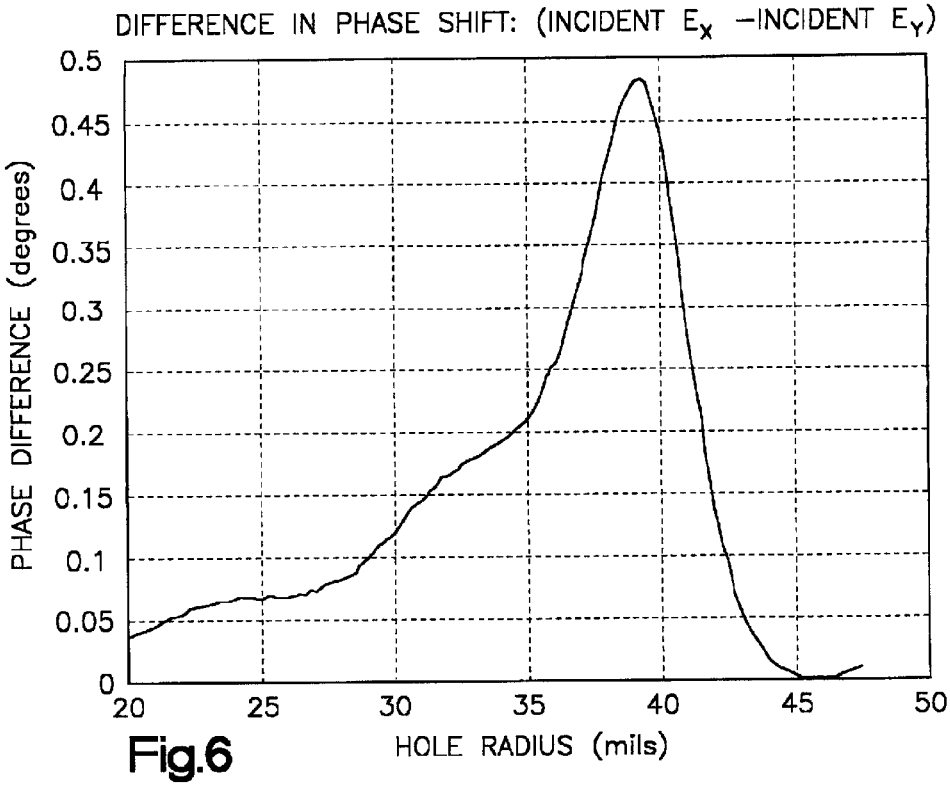
FIG. 6 is a graph showing the difference between the reflection phase shifts for the two orthogonally incident plane waves shown in FIG. 5.

Furthermore, for an equilateral triangular array arrangement of cavities the local phase shift is substantially the same for either incident polarization, indicating that the local phase shift is independent of the polarization of the incident wave. This is illustrated with greater clarity by FIG. 6, in which the difference between the local phase shifts for the two orthogonal polarizations is plotted as a function of cavity radius. The maximum phase difference is less than 0.5°. Thus, an incident plane wave of any polarization, whether linear, circular, or elliptical, will be focused at the focal point and its polarization can be preserved.

As discussed above, the size of the central cavity, a(0,0), can be used to determine the size of the remaining cavities. In determining a(0,0), a number of criteria can be used, including for example, to minimize the number of different quantized cavity sizes. In the illustrated embodiment, the array of cavities was machine reamed in an aluminum plate. The cost of fabrication was minimized by limiting the cavity diameters to a discrete set defined by a set of standard off-the-shelf reamers, thereby minimizing the cost of tooling. Other criteria may be used if a different fabrication technique is used. For example, the cavities could also be formed by electronic discharge machining (EDM) techniques.

When the number of different quantized cavity sizes were calculated for a plurality of possible values of a(0,0) for the illustrated reflector plate, it was found that the number of different quantized cavity sizes ranged from 67 to 79, with the minimum number occurring for a radius, a(0,0), of about 44.5 mils (about 1.13 mm). As a result of cavity-size quantization, however, the local phase shift imparted by each cavity may be slightly different from the ideal value, resulting in a phase error. For the illustrated reflector plate, the root-mean-square (rms) phase error resulting from the cavity-size quantization was found to be approximately two degrees (2°) at a frequency of 95 GHZ (which corresponds to an rms surface error of less than 0.5 mils (about 12.7 $\mu$m) for an equivalent curved-surface reflector), and was nearly independent of the value of a(0,0).

Since the cavities in the illustrated exemplary embodiment are arranged in a uniform equilateral triangular grid, the layout is determined by the distance $d_x$ between nearest neighbors, as illustrated in FIG. 4. In the illustrated embodiment, the distance $d_x$ is approximately 105 mils (about 2.7 mm). Several criteria were used in choosing this value of $d_x$. First, the need to avoid reflected-wave grating lobes imposes an upper bound on the value of $d_x$. For an isosceles-triangular array, grating lobes generally cannot exist if the following conditions are satisfied:

$$2\frac{\lambda}{d_x} \geq 1 + \sin\theta, \ \frac{\lambda}{d_y} \geq 1 + \sin\theta,$$

-continued $$\left(\frac{\lambda}{d_x}\right)^2+\left(\frac{\lambda}{2d_y}\right)^2 \geq (1+\sin\theta)^2,$$

where θ is the angle of incidence of an incident plane wave with respect to the axis of the reflector. If the array of cavities is arranged in an equilateral triangular pattern, $d_y=d_x\cdot\sin(60°)$. For normal incidence, θ=0, and grating lobes generally cannot exist if $d_x$ is less than about 143 mils (about 3.6 mm). This represents the upper bound on the value of $d_x$.

Second, the chosen value of $d_x$ must provide a realizable range of phase shifts as the cavity radius is varied. Numerical simulations show that the range of obtainable phase shifts generally increases as $d_x$ increases; however, the rate of change with cavity radius increases dramatically, so that nearly the entire range of possible phase shifts is realized over a very narrow range of cavity radii. That is, as $d_x$ increases the phase shift is increasingly sensitive to small changes in cavity radius. As the value of $d_x$ is reduced, the range of obtainable phase shifts decreases, and the rate of change of the reflection phase shift with cavity radius also decreases, so that the phase shift is less sensitive to small changes in cavity radius. The lower limit on $d_x$ is that at which the range of reflection phase shifts spans at least 360° (2π radians) and is obtained for a realizable range of cavity radii, with the largest cavity having a diameter less than $d_x$, and with some margin to allow for sufficient wall thickness between cavities. For the illustrated embodiment, the distance $d_x$ was chosen to be about 105 mils (2.7 mm) because it yields a reflection phase shift that varies gradually with cavity radius, as illustrated in FIG. 5. The maximum cavity radius was limited by this choice to about 47.5 mils (about 1.2 mm), providing a minimum distance of about 10 mils (about 0.25 mm) between neighboring cavities.

Figure 7:
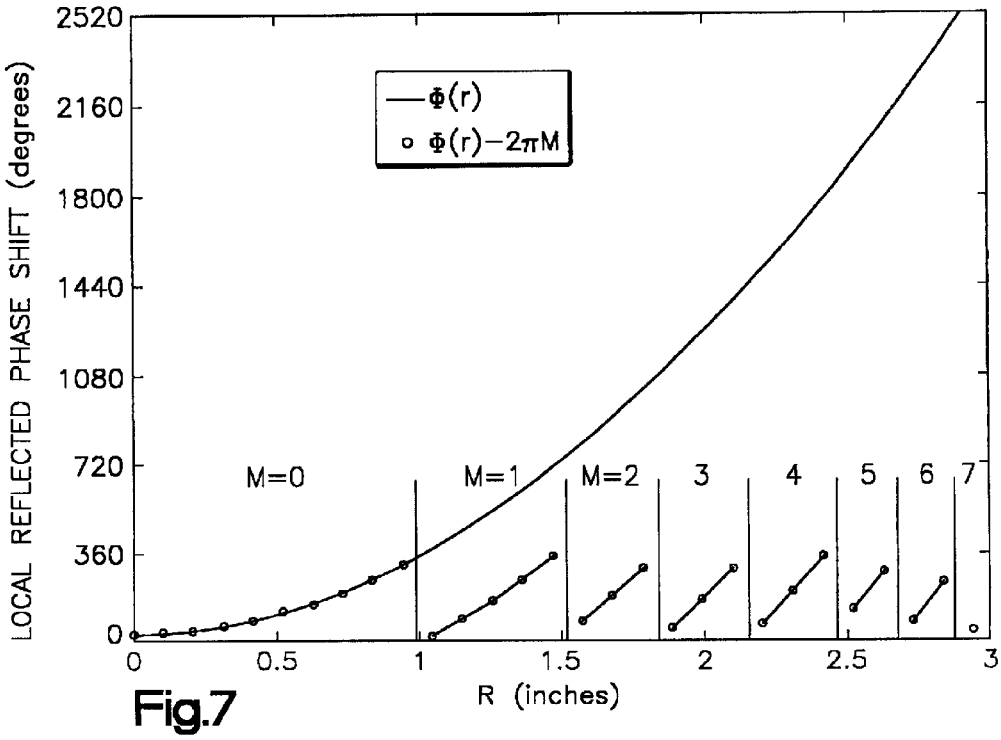
FIG. 7 is a graph showing the local phase shifts as a function of radial position on the reflector for the exemplary flat reflector shown in FIG. 1.

As shown in FIGS. 1–3, the array appears to form concentric rings with annular discontinuities in cavity size at periodic distances from the center of the plate 20. Equation (3) indicates that the local phase shift φ(r) increases monotonically with r. If the frequency is 95 GHZ and the focal length f is 4.5 inches, for example, the local phase shift at a distance r of approximately 3 inches from the center axis, relative to that at r=0, is 2632°. FIG. 5 indicates that such a range of phase shifts cannot be accommodated by a continuous increase in hole radius, as the hole radius is constrained by the need to maintain a minimum distance between neighboring cavities. If the required local phase shift lies outside the range covered in FIG. 5, multiples of 360° can be subtracted until a phase shift lying inside the range covered in FIG. 5 is obtained. This behavior is illustrated in FIG. 7, which shows the ideal continuous local phase shift φ(r) as obtained from Equation (3) when φ(0) is approximately 27.02° (corresponding to a(0,0) of approximately 44.5 mils (about 1.13 mm)) and the realized phase shifts obtained by subtracting from φ(r) integral multiples of 2π radians (360°). The explanation for the discontinuities in hole radius seen in FIGS. 1 and 2 can be found in FIG. 7; as the local phase shift passes just beyond the range covered in FIG. 5, the hole radius must jump suddenly to the other side of the curve to maintain continuity of the local phase shift (modulus 2π).

The illustrated reflector plate was designed for millimeter-waves in the W band at approximately 95 GHz, and the resulting antenna is expected to be useful for broadband communications. Naturally, the present invention also provides an antenna for use at other frequencies, although the size of the cavity opening generally increases with lower frequencies.

Furthermore, although the illustrated embodiment has an array of circular openings of varying radius across the conductive surface, and the cavities have uniform depth and spacing, one or more other properties, such as cavity depth, could be varied to produce the desired local phase shifts. The reflector plate also could be formed as a single piece, without the backing plate. In addition, although the illustrated reflector is a geometrically flat plate, the reflector could have a regular or arbitrarily curved conductive surface that is perforated with appropriately selected cavities to compensate for errors in forming the curved surface, or to emulate a different shape, such as a semi-spherical surface emulating a hyperboloidal surface.

Finally, the illustrated embodiment is but one example of a more general class of devices based on the technology described herein that can be used to transform an incident wavefront having a given shape to a reflected wavefront having a different shape, a wavefront being a surface of constant phase. The illustrated reflector transforms an incident planar wavefront into a reflected spherical wave that converges on the focal point in receive mode, and transforms a spherical wave into a reflected planar wavefront in transmit mode. Far more general wavefront transformations are possible with the present invention; for example, one can construct phase correcting mirrors for use in a beam waveguide system.

Although the invention has been shown and described with respect to a certain preferred embodiment, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment of the invention. In addition, while a particular feature of the invention may have been described above with respect to only one embodiment, such feature may be combined with one or more other features of other embodiments, as may be desired and advantageous for any given or particular application.

What is claimed is:

1. A wavefront transformer suitable for transforming an incident electromagnetic wavefront having a given shape to a reflected wavefront having a different shape, comprising: a substrate having a substantially flat conductive surface for reflecting incident electromagnetic energy, and a plurality of openings in the conductive surface, each opening formed by a respective one of a plurality of discrete cavities extending from the conductive surface, each cavity having a bottom surface, each cavity having a selected position on the conductive surface with respect to a focal point to induce a propagation phase shift over the distance to the focal point, each cavity inducing a local phase shift in the reflected electromagnetic energy as a function of a selected dimension of the cavity, and the combined propagation phase shift and local phase shift from the plurality of cavities places the reflected electromagnetic energy in phase at the focal point.

2. A wavefront transformer as set forth in claim 1, wherein the substrate is a metal plate.

3. A wavefront transformer as set forth in claim 2, wherein the plate is substantially flat.

4. A wavefront transformer as set forth in claim 2, wherein the plate includes a first plate overlying a second plate, wherein the first plate has a plurality of through-holes therein that form the cavities and the second plate forms a flat bottom surface of the cavities.

5. A wavefront transformer as set forth in claim 2, wherein the plate has a substantially uniform thickness.

6. A wavefront transformer as set forth in claim 1, wherein one or more properties of the cavities varies with position with respect to the focal point.

7. A wavefront transformer as set forth in claim 6, wherein the properties that vary include dimensions of the cavities and spacing between neighboring cavities.

8. A wavefront transformer as set forth in claim 7, wherein the dimensions of the cavities include cross-sectional dimensions that include one or more of width, depth and radius.

9. A wavefront transformer as set forth in claim 1, wherein the plurality of cavities form a periodic array.

10. A wavefront transformer as set forth in claim 1, wherein the cavities have a depth that is less than a local thickness of the plate.

11. A wavefront transformer as set forth in claim 1, wherein the openings are circular.

12. A wavefront transformer as set forth in claim 1, wherein the cavities are cylindrical.

13. A wavefront transformer as set forth in claim 1, wherein the plurality of cavities are arrayed in an equilateral-triangular arrangement.

14. A reflector suitable for focusing incident electromagnetic energy at an operating wavelength on a focal point, including the wavefront transformer of claim 1.

15. An antenna, comprising: the reflector of claim 14 and a waveguide feed located at the focal point.

16. A wavefront transformer suitable for transforming an incident electromagnetic wavefront having a given shape to a reflected wavefront having a different shape, comprising: a substrate having a conductive surface for reflecting the incident electromagnetic energy, and a plurality of openings in the conductive surface, each opening formed by a respective one of a plurality of discrete cavities extending from the conductive surface, each cavity having a selected position on the conductive surface with respect to the focal point to induce a propagation phase shift over the distance to the focal point, each cavity inducing a local phase shift in the reflected electromagnetic energy as a function of a selected dimension of the cavity, the combined propagation phase shift and local phase shift from the plurality of cavities places the reflected electromagnetic energy in phase at the focal point, wherein only the positions of the cavities and the selected dimension of the cavities varies, the dimension of each cavity is selected such that the total phase shift at the focal point of an electromagnetic wave reflected from each cavity is equal, so that $$\phi(r) = \phi(0) + \frac{2\pi}{\lambda}\left(\sqrt{r^2 + f^2} - f\right),$$

where r is the distance of the cavity from a reference point in the plane of the conductive surface, $\phi(r)$ is the local phase shift imposed on an incident electromagnetic wave at r by the flat reflecting surface, f is the focal length of the reflector, $\lambda$ is a desired wavelength of the reflected electromagnetic energy, and $\phi(\mathbf{0})$ is the local phase shift imposed on an incident electromagnetic wave by a cavity at the reference point having a dimension a(0,0).

17. A wavefront transformer as set forth in claim 16, wherein the wavefront transformer has a focal length of about four and a half inches (about 11.4 cm).

18. A wavefront transformer as set forth in claim 16, wherein a(0,0) is a radius of a circular opening formed by a cylindrical cavity.

19. A wavefront transformer as set forth in claim 18, wherein a(0,0) is about 44.5 mils (about 254 $\mu$m).

20. A wavefront transformer as set forth in claim 16, wherein the cavity dimension is selected for frequencies greater than about 20 GHZ.

21. A wavefront transformer as set forth in claim 20, wherein the cavity dimension is selected for a frequency of about 95 GHZ.

22. A wavefront transformer as set forth in claim 16, wherein the cavities have a uniform depth of about 100 mils (about 2.54 mm).

23. A wavefront transformer as set forth in claim 16, wherein the nearest-neighbor distance between adjacent cavities is uniform.

24. A wavefront transformer as set forth in claim 16, wherein the nearest-neighbor distance between adjacent cavities is about 105 mils (about 2.67 mm).

25. A method of making a reflector suitable for focusing incident electromagnetic energy at an operating wavelength on a focal point, the wavefront transformer having a substrate with a conductive surface for reflecting the incident electromagnetic energy, and a plurality of openings in the conductive surface, each opening formed by a respective one of a plurality of discrete cavities extending from the conductive surface, the method comprising: selecting a dimension of each cavity as a function of a propagation phase shift and a local phase shift created by the cavity at a desired distance from the focal point, and forming the cavities in a conductive surface, wherein the dimension of each cavity is selected such that the local phase shift imposed on an incident electromagnetic wave is $$\phi(r) = \phi(0) + \frac{2\pi}{\lambda}\left(\sqrt{r^2 + f^2} - f\right)$$

where r is the distance of the cavity from a reference point on the conductive surface, f is the focal length of the wavefront transformer, $\lambda$ is a desired wavelength of the reflected electromagnetic energy, and $\phi(\mathbf{0})$ is the local total phase shift imposed on an incident electromagnetic wave at the reference point by a cavity having a dimension a(0,0).

26. A method as set forth in claim 25, wherein forming the cavities includes forming the cavities in an equilateral-triangular arrangement.

27. A method as set forth in claim 25, wherein forming the cavities includes forming through-holes in a first plate and mounting the first plate on a backing plate that forms a solid bottom surface for each hole.

28. A method as set forth in claim 25, wherein forming the cavities includes machine reaming.

29. A method as set forth in claim 25, wherein forming the cavities includes using electronic discharge machining.

30. An antenna suitable for focusing incident electromagnetic energy at an operating wavelength on a focal point, comprising: a geometrically flat wavefront transformer plate having a substantially flat conductive surface and a waveguide feed positioned at the focal point suitable to receive reflected electromagnetic energy; the wavefront transformer plate further includes a plurality of discrete cavities opening in the conductive surface, each cavity having a bottom surface, the dimensions of each cavity varying as a function of the position of the cavity on the plate with respect to the focal point to induce a local phase shift on the incident wave of electromagnetic energy as the electromagnetic energy is reflected, the cavities being spaced with respect to adjacent cavities to enable the wavefront transformer plate to focus the reflected electromagnetic energy at the focal point such that electromagnetic energy reflected from the wavefront transformer plate is in phase at the focal point.

31. An antenna as set forth in claim 30, wherein the cavities are arrayed in an equilateral-triangular arrangement.

32. A reflective wavefront transformer for transforming an incident electromagnetic wavefront having equal-phase surfaces of a given first shape into a reflected electromagnetic wavefront having equal-phase surfaces having a desired second shape, comprising: a substrate having an arbitrarily-shaped conductive surface, and a plurality of openings in the arbitrarily-shaped conductive surface, each opening forming one end of a discrete cavity extending from the arbitrarily-shaped conductive surface, each cavity having a bottom conductive surface and selected dimensions, each cavity having a selected position on the arbitrarily-shaped conductive surface to impose a position-dependent phase shift on the reflected wavefront required to transform the incident wavefront from the given first shape into a reflected wavefront of the desired second shape.

33. A wavefront transformer as set forth in claim 32, wherein the substrate has a substantially flat conductive surface.

34. A wavefront transformer as set forth in claim 32, wherein the bottom conductive surface of each cavity is flat.

35. A method of making a reflective wavefront transformer for transforming an incident electromagnetic wavefront having equal-phase surfaces of a given first shape into a reflected electromagnetic wavefront having equal-phase surfaces having a desired second shape, comprising: providing a substrate having an arbitrarily-shaped conductive surface; forming a plurality of openings in the arbitrarily-shaped conductive surface, each opening forming one end of a discrete cavity extending from the arbitrarily-shaped conductive surface, each cavity having a bottom conductive surface and selected dimensions; selecting a position of each cavity on the arbitrarily-shaped conductive surface to impose a position-dependent phase shift on the reflected wavefront required to transform the incident wavefront from the given first shape into a reflected wavefront of the desired second shape.

* * * * *